US010600566B2

(12) United States Patent
Hu et al.

(10) Patent No.: US 10,600,566 B2
(45) Date of Patent: Mar. 24, 2020

(54) METHOD FOR FORMING A PLANAR, CLOSED LOOP MAGNETIC STRUCTURE

(71) Applicant: INTERNATIONAL BUSINESS MACHINES CORPORATION, Armonk, NY (US)

(72) Inventors: Guohan Hu, Yorktown Heights, NY (US); Naigang Wang, Yorktown Heights, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 491 days.

(21) Appl. No.: 15/292,625

(22) Filed: Oct. 13, 2016

(65) Prior Publication Data

US 2018/0108468 A1 Apr. 19, 2018

(51) Int. Cl.

| | |
|---|---|
| ***H01F 7/06*** | (2006.01) |
| ***H01F 41/04*** | (2006.01) |
| ***H01F 27/28*** | (2006.01) |
| ***H01F 17/00*** | (2006.01) |
| ***H01F 3/10*** | (2006.01) |

(52) U.S. Cl.

CPC ..... *H01F 41/046* (2013.01); *H01F 3/10* (2013.01); *H01F 17/0033* (2013.01); *H01F 27/2804* (2013.01); *H01F 2003/106* (2013.01)

(58) Field of Classification Search

CPC .... H01F 3/10; H01F 17/0033; H01F 27/2804; H01F 41/046

See application file for complete search history.

(56) References Cited

U.S. PATENT DOCUMENTS

| | | | | |
|---|---|---|---|---|
| 4,103,315 | A | 7/1978 | Hempstead et al. | |
| 6,535,361 | B2 | 3/2003 | Cain et al. | |
| 7,088,215 | B1 | 8/2006 | Winter et al. | |
| 7,317,374 | B2 * | 1/2008 | Flanders | H01F 3/14 336/182 |
| 7,501,924 | B2 | 3/2009 | Zhang | |
| 7,884,551 | B2 | 2/2011 | Shun'ko | |
| 9,030,785 | B2 | 5/2015 | Freitag et al. | |
| 9,773,612 | B2 * | 9/2017 | El-Ghazaly | H01F 41/14 |

(Continued)

OTHER PUBLICATIONS

Frommberger, M. et al., "Integration of Crossed Anisotropy Magnetic Core Into Toroidal Thin-Film Inductors" IEEE Transactions on Microwave Theory and Techniques (Jun. 2005) pp. 2096-2100, vol. 53, No. 6.

(Continued)

*Primary Examiner* — Paul D Kim

(74) *Attorney, Agent, or Firm* — Tutunjian & Bitetto, P.C.; Vazken Alexanian

(57) ABSTRACT

A planar magnetic structure includes a closed loop structure having a plurality of core segments divided into at least two sets. A coil is formed about one or more core segments. A first antiferromagnetic layer is formed on a first set of core segments, and a second antiferromagnetic layer is formed on a second set of core segments. The first and second antiferromagnetic layers include different blocking temperatures and have an easy axis pinning a magnetic moment in two different directions, wherein when current flows through the coil, the magnetic moments rotate to form a closed magnetic loop in the closed loop structure.

12 Claims, 6 Drawing Sheets

(56) References Cited

U.S. PATENT DOCUMENTS

| | | | | |
|---|---|---|---|---|
| 9,991,040 | B2 * | 6/2018 | Sturcken | H01F 13/003 |
| 2008/0106364 | A1 | 5/2008 | Orlando et al. | |
| 2010/0194510 | A1 | 8/2010 | Pruegl | |
| 2017/0094728 | A1 | 3/2017 | Mortimer | |

OTHER PUBLICATIONS

Gardener, D.S. et al., "Integrated on-chip inductors using magnetic material (invited)" Journal of Applied Physics (Apr. 2008) pp. 07E927-1-07E927-6, vol. 103.

Wang, N. et al., "Integrated on-chip inductors with electroplated magnetic yokes (invited)" Journal of Applied Physics (Mar. 2012) pp. 07E732-1-07E732-6, vol. 111.

Wright, J.M. et al., "Analysis of Integrated Solenoid Inductor With Closed Magnetic Core" IEEE Transactions on Magnetics (Jun. 2010) pp. 2387-2390, vol. 46, No. 6.

* cited by examiner

METHOD FOR FORMING A PLANAR, CLOSED LOOP MAGNETIC STRUCTURE

BACKGROUND

Technical Field

The present invention generally relates to inductors, and more particularly to solenoid inductors having antiferromagnetic pinned cores that form a closed magnetic loop.

Description of the Related Art

On-chip magnetic inductors/transformers are important passive elements that are useful in a wide array of applications in fields such as on-chip power converters and radiofrequency (RF) integrated circuits. Magnetic inductors are composed of a set of coils to carry currents and a magnetic yoke/core to store magnetic energy. Due to the high reluctance of air gaps, a closed magnetic loop is highly desired to obtain high inductance. However, due to a uniaxial anisotropy requirement for magnetic materials and a planar nature of on-chip devices, forming a closed magnetic flux loop has been challenging. For example, if two solenoidal inductors are put in parallel, and the cores are connected, the two inductors act like two independent inductors, i.e. the flux is not closed.

SUMMARY

In accordance with an embodiment of the present invention, a planar magnetic structure includes a closed loop structure having a plurality of core segments divided into at least two sets. A coil is formed about at least one core segment. A first antiferromagnetic layer is formed on a first set of core segments, and a second antiferromagnetic layer is formed on a second set of core segments. The first and second antiferromagnetic layers include different blocking temperatures and have an easy axis pinning a magnetic moment in at least two different directions, wherein when current flows through the coil, the magnetic moments rotate to form a closed magnetic loop in the closed loop structure.

A method for forming a planar, closed loop magnetic structure includes forming a first antiferromagnetic layer at a first blocking temperature for a closed magnetic loop to define a first pin direction for first magnetic moments; forming a second antiferromagnetic layer at a second blocking temperature lower than the first blocking temperature for the closed magnetic loop to define a second pin direction different from the first pin direction for second magnetic moments; and forming a coil around at least one core segment of the closed magnetic loop such that when the coil is energized the first and second magnetic moments rotate to follow a contour of the closed magnetic loop.

Another method for forming a planar, closed loop magnetic structure includes forming a planar, closed loop ferromagnetic core having four sides; patterning a first antiferromagnetic layer on two opposing sides of the ferromagnetic core; annealing the first antiferromagnetic layer at a first blocking temperature to define a first pin direction for first magnetic moments; patterning a second antiferromagnetic layer on two other opposing sides of the ferromagnetic core; annealing the second antiferromagnetic layer at a second blocking temperature, which is lower than the first blocking temperature to define a second pin direction for second magnetic moments; and forming a coil around at least one core segment of the closed loop ferromagnetic core such that when the coil is energized the first and second magnetic moments rotate to follow a contour of the closed loop ferromagnetic core.

These and other features and advantages will become apparent from the following detailed description of illustrative embodiments thereof, which is to be read in connection with the accompanying drawings.

BRIEF DESCRIPTION OF THE DRAWINGS

The following description will provide details of preferred embodiments with reference to the following figures wherein.

DETAILED DESCRIPTION

Figure 1:
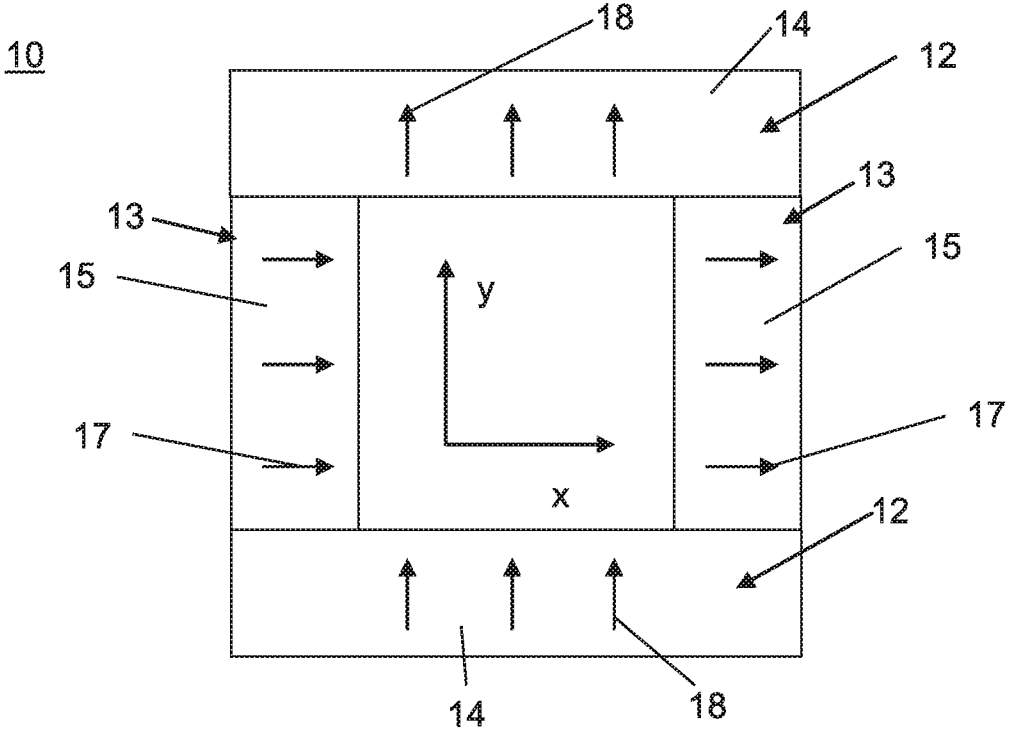
FIG. 1 is a top view showing a closed loop planar magnetic structure having core segments orthogonally pinned using two antiferromagnetic materials in accordance with an embodiment of the present invention.

Present embodiments provide magnetic structures, and in particular, closed, in-plane magnetic loop structures. In useful embodiments, the magnetic loop structures include antiferromagnetic (AF) materials formed using different blocking temperatures. The AF materials are employed to independently pin each core segment to form the closed, in-plane magnetic loop for a planar solenoidal inductor. The closed magnetic loop dramatically increases inductance density and coupling coefficient of the inductors.

In one embodiment, two AF materials with different blocking temperatures are employed for opposing core segments of a magnetic core. The opposing pairs of the core segments are independently pinned to form the closed, in-plane magnetic loop. For example, two first magnetic core segments and two second magnetic core segments form a complete magnetic core. The first core segments include a first AF material (e.g., IrMn) with a higher blocking temperature, while the second core segments include a second AF material (e.g., FeMn) with a lower blocking temperature. By annealing the first core at the first blocking temperature in an external field in one direction, followed by annealing the second core at the second blocking temperature in a field in an orthogonal direction to the first field direction, an orthogonal anisotropy on different core segments can be obtained.

It is to be understood that aspects of the present invention will be described in terms of a given illustrative architecture; however, other architectures, structures, substrate materials and process features and steps can be varied within the scope of aspects of the present invention.

It will also be understood that when an element such as a layer, region or substrate is referred to as being "on" or "over" another element, it can be directly on the other element or intervening elements can also be present. In contrast, when an element is referred to as being "directly on" or "directly over" another element, there are no intervening elements present. It will also be understood that when an element is referred to as being "connected" or "coupled" to another element, it can be directly connected or coupled to the other element or intervening elements can be present. In contrast, when an element is referred to as being "directly connected" or "directly coupled" to another element, there are no intervening elements present.

The present embodiments can include a design for an integrated circuit chip, which can be created in a graphical computer programming language, and stored in a computer storage medium (such as a disk, tape, physical hard drive, or virtual hard drive such as in a storage access network). If the designer does not fabricate chips or the photolithographic masks used to fabricate chips, the designer can transmit the resulting design by physical means (e.g., by providing a copy of the storage medium storing the design) or electronically (e.g., through the Internet) to such entities, directly or indirectly. The stored design is then converted into the appropriate format (e.g., GDSII) for the fabrication of photolithographic masks, which typically include multiple copies of the chip design in question that are to be formed on a wafer. The photolithographic masks are utilized to define areas of the wafer (and/or the layers thereon) to be etched or otherwise processed.

Methods as described herein can be used in the fabrication of integrated circuit chips. The resulting integrated circuit chips can be distributed by the fabricator in raw wafer form (that is, as a single wafer that has multiple unpackaged chips), as a bare die, or in a packaged form. In the latter case, the chip is mounted in a single chip package (such as a plastic carrier, with leads that are affixed to a motherboard or other higher level carrier) or in a multichip package (such as a ceramic carrier that has either or both surface interconnections or buried interconnections). In any case, the chip is then integrated with other chips, discrete circuit elements, and/or other signal processing devices as part of either (a) an intermediate product, such as a motherboard, or (b) an end product. The end product can be any product that includes integrated circuit chips, ranging from toys and other low-end applications to advanced computer products having a display, a keyboard or other input device, and a central processor.

It should also be understood that material compounds will be described in terms of listed elements, e.g., FeMn. These compounds include different proportions of the elements within the compound, e.g., FeMn includes $Fe_xMn_{1-x}$ where x is less than or equal to 1, etc. In addition, other elements can be included in the compound and still function in accordance with the present principles. The compounds with additional elements will be referred to herein as alloys.

Reference in the specification to "one embodiment" or "an embodiment", as well as other variations thereof, means that a particular feature, structure, characteristic, and so forth described in connection with the embodiment is included in at least one embodiment. Thus, the appearances of the phrase "in one embodiment" or "in an embodiment", as well any other variations, appearing in various places throughout the specification are not necessarily all referring to the same embodiment.

It is to be appreciated that the use of any of the following "/", "and/or", and "at least one of", for example, in the cases of "A/B", "A and/or B" and "at least one of A and B", is intended to encompass the selection of the first listed option (A) only, or the selection of the second listed option (B) only, or the selection of both options (A and B). As a further example, in the cases of "A, B, and/or C" and "at least one of A, B, and C", such phrasing is intended to encompass the selection of the first listed option (A) only, or the selection of the second listed option (B) only, or the selection of the third listed option (C) only, or the selection of the first and the second listed options (A and B) only, or the selection of the first and third listed options (A and C) only, or the selection of the second and third listed options (B and C) only, or the selection of all three options (A and B and C). This can be extended, as readily apparent by one of ordinary skill in this and related arts, for as many items listed.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Spatially relative terms, such as "beneath," "below," "lower," "above," "upper," and the like, can be used herein for ease of description to describe one element's or feature's relationship to another element(s) or feature(s) as illustrated in the FIGS. It will be understood that the spatially relative terms are intended to encompass different orientations of the device in use or operation in addition to the orientation depicted in the FIGS. For example, if the device in the FIGS. is turned over, elements described as "below" or "beneath" other elements or features would then be oriented "above" the other elements or features. Thus, the term "below" can encompass both an orientation of above and below. The device can be otherwise oriented (rotated 90 degrees or at other orientations), and the spatially relative descriptors used herein can be interpreted accordingly. In addition, it will also be understood that when a layer is referred to as being "between" two layers, it can be the only layer between the two layers, or one or more intervening layers can also be present.

It will be understood that, although the terms first, second, etc. can be used herein to describe various elements, these elements should not be limited by these terms. These terms are only used to distinguish one element from another element. Thus, a first element discussed below could be termed a second element without departing from the scope of the present concept.

Referring now to the drawings in which like numerals represent the same or similar elements and initially to FIG. 1, a layout view of a planar magnetic structure 10 is illustratively depicted in accordance with one embodiment. The structure 10 includes a closed flux loop including opposing core segments 12 and 13. Core segments 12 include a first material 14, and core segments 13 include a second material 15. The structure 10 is formed in a single plane or layer of an on-chip device.

A closed magnetic loop is highly desired to enhance inductance in magnetic on-chip structures, such as inductors, transformers, solenoids, etc. An example of a conventional on-chip inductor needs to employ magnetic via designs with two layers of magnetic yokes required. In the magnetic via structure, two magnetic yokes enclose a set of copper coils and are connected at the ends of the yokes through the magnetic vias. Inductance can be greatly enhanced, but this structure requires two layers of magnetic materials, and the structure is complex. Since the processing of the magnetic materials is often the most difficult part in the inductor fabrication, two magnetic layers are not desired.

Another conventional example includes a cross-anisotropy structure where only half of the magnetic moments are rotating at a time. The cross-anisotropy structure can be solenoidal or toroidal, which means that a magnetic core is surrounded by multi-turn copper coils. The magnetic core is composed of multilayered magnetic materials with the anisotropy of two adjacent layers perpendicular to each other. When a magnetic field is applied by input currents in either direction, one set of the magnetic layers will rotate. One problem with this structure is that only half of the magnetic materials are functioning at a time. One needs to deposit twice the amount of magnetic materials to achieve the same performance.

The present structure 10 employs antiferromagnetic (AF) materials 14, 15 that can be used to pin magnetic moments 16, 17, respectively of a ferromagnetic layer (not shown) to a uniaxial anisotropy through exchange coupling. Pinning directions can be defined by annealing the magnetic layers in an external magnetic field. In addition, the different antiferromagnetic materials 14, 15 have different block temperatures.

AF materials 14, 15 can include transition metal compounds, especially oxides. Examples include hematite, metals, such as, e.g., chromium (Cr), alloys such as iron manganese (FeMn) or iridium manganese (IrMn), and oxides such as nickel oxide (NiO). AF material can couple to ferromagnetic materials by exchange bias, in which the ferromagnetic layer is either grown upon the AF material or annealed in an aligning magnetic field, causing the surface atoms of the ferromagnetic material to align with the surface atoms of the AF material 14, 15. This provides the ability to pin an orientation of a ferromagnetic film (not shown). The temperature at or above which an AF material 14, 15 loses its ability to pin the magnetization direction of an adjacent ferromagnetic layer is called the blocking temperature of that layer. The blocking temperature is usually lower than the Néel temperature for the material.

AF material has the magnetic moments of the atoms (the spins of electrons) align in a regular pattern with neighboring spins directed in opposite directions, as opposed to a same direction in ferromagnetic material. Antiferromagnetic order usually exists at sufficiently low temperatures, and disappears above the Néel temperature, above which the material becomes paramagnetic.

The structure 10 is constrained by uniaxial anisotropy so that the magnetization aligns to one single direction, so that when the inductor or other device formed by the structure 10 is operating, input current will generate a magnetic field which will rotate the magnetization to store the energy. Uniaxial anisotropy limits high permeability in magnetic films to only one direction. The magnetic flux travels along the high permeability direction (perpendicular to an easy axis). It is very difficult to form a closed magnetic loop with uniaxial anisotropy.

The magnetic moments 16, 17 align with the easy axis of their respective materials 14, 15. The easy axis is an energetically favorable direction of spontaneous magnetization. The two opposite directions along the easy axis are usually equivalent, and the actual direction of magnetization can be along either direction. In the Stoner-Wohlfarth model, the magnetization (vector M) does not vary within the ferromagnet. The M vector rotates as the magnetic field H changes, and the magnetic field is varied along a single axis. As the magnetic field varies, the magnetization is restricted to the plane including the magnetic field direction and the easy axis.

In accordance with one embodiment, magnetic core segments 12 and magnetic core segments 13 form a complete magnetic core or structure 10. Segments 12 include first AF materials 14 (e.g., IrMn) having a higher blocking temperature (e.g., about 300 degrees C.), while the core segments 13 include second AF materials 15 (e.g., FeMn) with a lower blocking temperature (e.g., 200 degrees C.). The materials, orientation and blocking temperatures can be varied in accordance with aspects of the present invention.

The core segments 12 are annealed at, e.g., 300 degrees C. in an external field in the "x" direction first. Then, the core segments 14 are annealed at another time at, e.g., 200 degrees C., with an external field in the y direction. This provides an orthogonal anisotropy between the core segments 12 and 14 as indicated by the magnetic moments 16 and 17, respectively. In this way, AF materials 14, 15 pin the magnetic moments 16, 17 of a ferromagnetic layer (on top of or below the AF materials 14, 15) to a uniaxial anisotropy through exchange coupling. Pinning directions corresponding to magnetic moments 16, 17 can be defined by annealing the magnetic layers in the applied external magnetic field. The AF materials 14, 15 include different blocking temperatures to independently pin each core segments to form the closed, in-plane magnetic loop structure 10.

Figure 2:
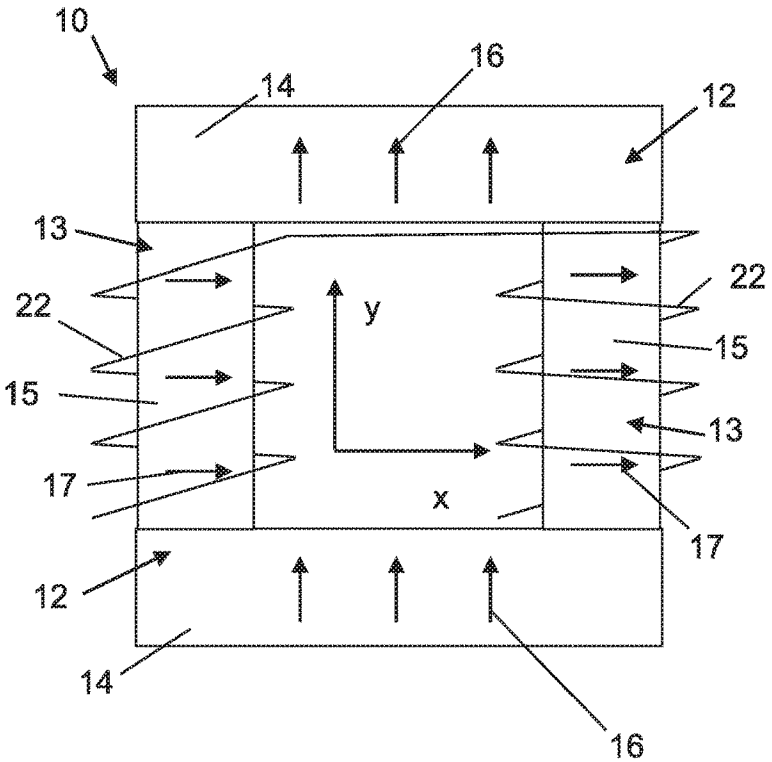
FIG. 2 is a top view showing the closed loop planar magnetic structure of FIG. 1 having a coil wound about two core segments prior to energizing the coil in accordance with an embodiment of the present invention.

Referring to FIG. 2, the structure 10 can be employed to form an inductor or inductors. The inductors employ one or more coils 22 to carry current to generate a magnetic field in operation. The coils 22 can include a highly conductive material.

The highly conductive material can include a metal (e.g., tungsten, titanium, tantalum, ruthenium, zirconium, cobalt, copper, aluminum, lead, platinum, tin, silver, gold), a conducting metallic compound material (e.g., tantalum nitride, titanium nitride, tungsten silicide, tungsten nitride, ruthenium oxide, cobalt silicide, nickel silicide), carbon nanotube, conductive carbon, graphene, or any suitable combination of these or other materials. The highly conductive material preferably includes Cu.

The one or more coils 22 can be formed around the core segments 13 in this embodiment using vias and metal lines formed in dielectric materials. The dielectric materials are not depicted and the coils 22 are depicted schematically for clarity reasons.

FIG. 2 shows the state of the structure 10 before applying current in the coils 22. The structure 10 has magnetic moments 16, 17 aligned to their easy axis defined by the AF materials (layers) 14, 15. In this embodiment, a same coil 22 winds around both core segments 13.

Figure 3:
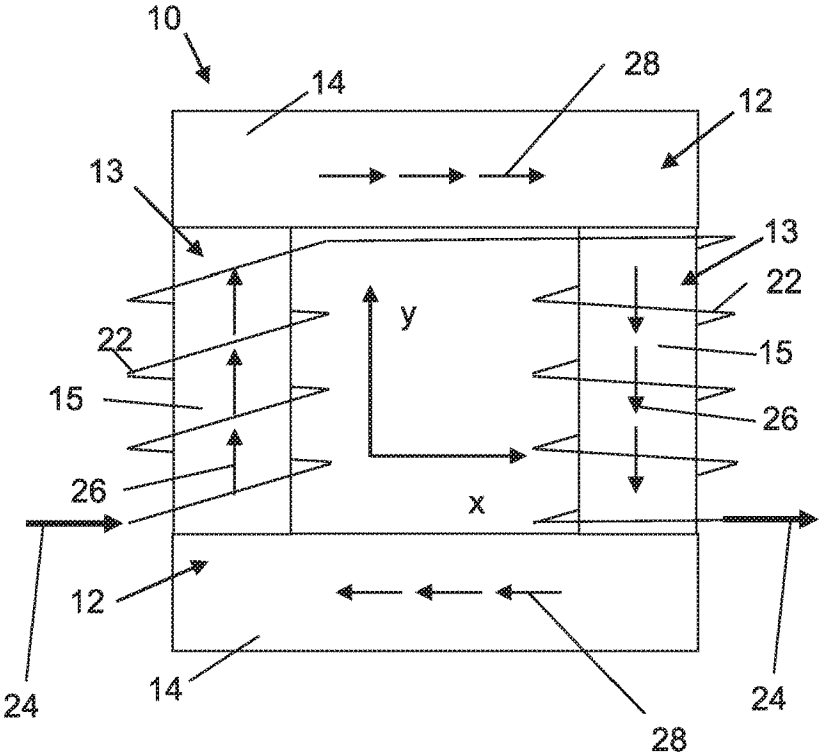
FIG. 3 is a top view showing the closed loop planar magnetic structure of FIG. 2 having the coil wound about two core segments after energizing the coil and showing magnetic moments rotated along a contour of the closed loop in accordance with an embodiment of the present invention.
Figure 4:
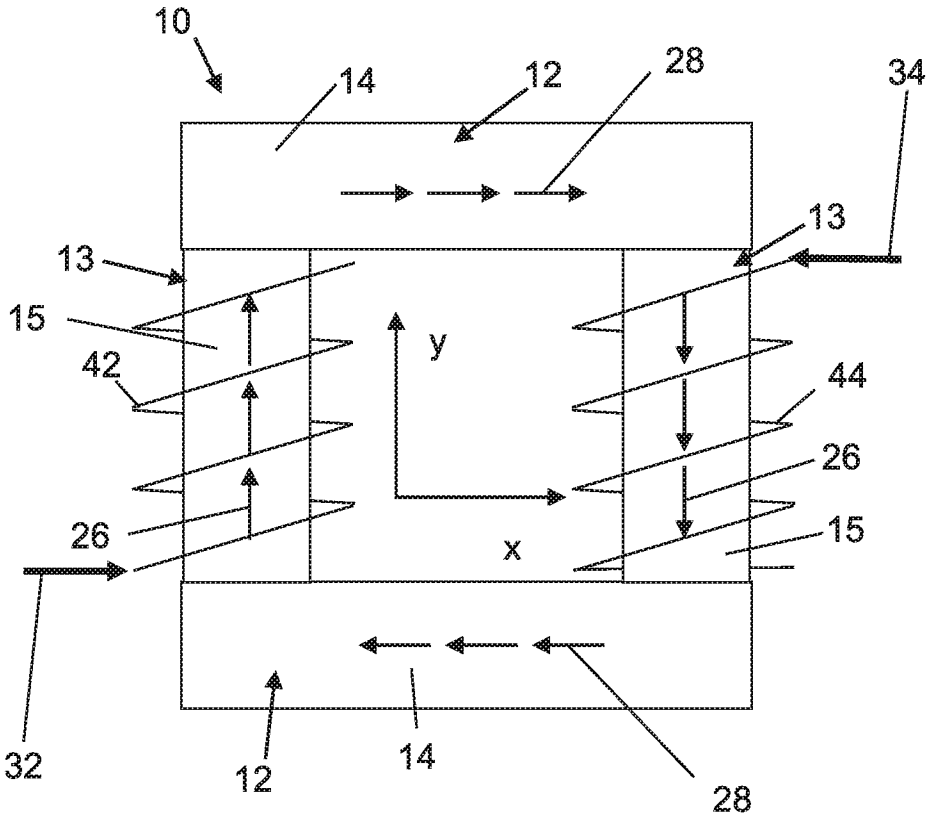
FIG. 4 is a top view showing a closed loop planar magnetic structure having individual coils formed on separate core segments to form coupled inductors in accordance with an embodiment of the present invention.

Referring to FIG. 3, a current 24 is applied to the coil 22. The state of the structure 10 changes by the application of current 24 in the coils 22. The structure 10 has magnetic moments 26, 28 rotated from their easy axis. While applying current 24, magnetic moments rotate to form a closed magnetic loop, and all magnetic energy can be stored inside of a low-reluctance magnetic core to enhance inductance density. The structure 10 can be used as a single inductor or a coupled inductor (FIG. 4). Coils can be included on one or more core segments. The coils can be wound on one or more of the core segments 12, 13 individually or over each set of core segments, e.g., one, two, three of four coils may be employed over one, two, three or four core segments.

Referring to FIG. 4, a coupled inductor structure 40 includes magnetic core segments 12 and magnetic core segments 13 that form a complete magnetic core. Segments 12 include AF materials 14, which have a different blocking temperature than the core segments 13 that include second AF materials 15. A current 32 is applied to a coil 42 of one core segment 13, and a current 34 flows in an opposite direction in a separate coil 44 wound about the other core segment 13. The currents 32 and 34 in coils 42 and 44, respectively, provide rotated magnetic moments 26, 28 from their easy axis. The closed low reluctance loop formed by the structure 40 dramatically improves a coupling coefficient between the inductors formed by coils 42 and 44. The coils can be wound on one or more of the core segments 12, 13 individually or over each set of core segments, e.g., one, two, three of four coils may be employed over one, two, three or four core segments. The currents 32 and 34 can be equal or not equal.

Figure 5:
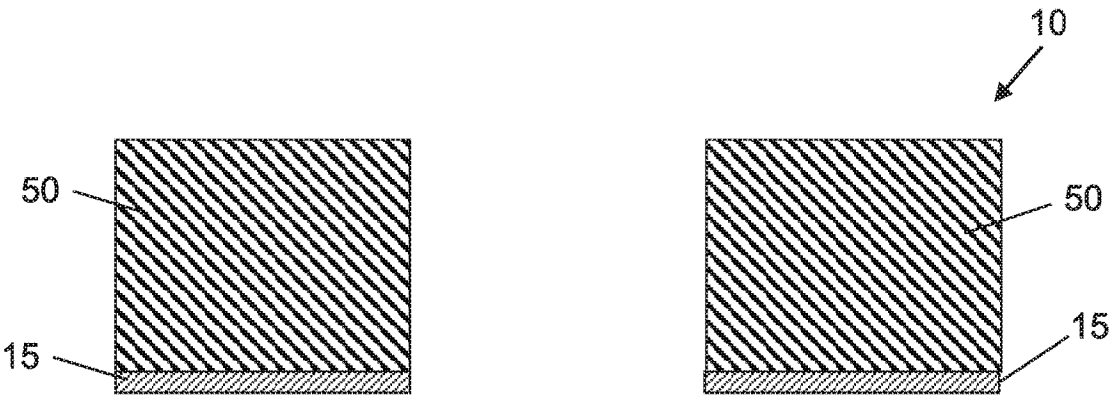
FIG. 5 is a cross-sectional view of a closed loop planar magnetic structure having a ferromagnetic material formed on an antiferromagnetic material in accordance with one embodiment.

Referring to FIG. 5, a cross-sectional view of the structure 10 is shown in accordance with one embodiment. The structure 10 includes AF material 15 (or 14) formed before forming a ferromagnetic material 50. The AF material or layer 15 is formed to pin the ferromagnetic material 50. The ferromagnetic material 50 can be grown on the AF material 15 to pin the ferromagnetic material 50 for at least one set of core segments. The ferromagnetic material 50 can include Fe, Mn, Ni, Co, alloys or combinations of these and other magnetic materials, such as soft magnetic materials, e.g., $Ni_{45}Fe_{55}$, $Ni_{80}Fe_{20}$, Co—Zr—Ta, Co—Zr—Ti, Co—W—P, Co—W—B, Co—Fe—B, Co—B, Fe—P, Fe—B, Fe—N, Co—Zr—O, etc.

Figure 6:
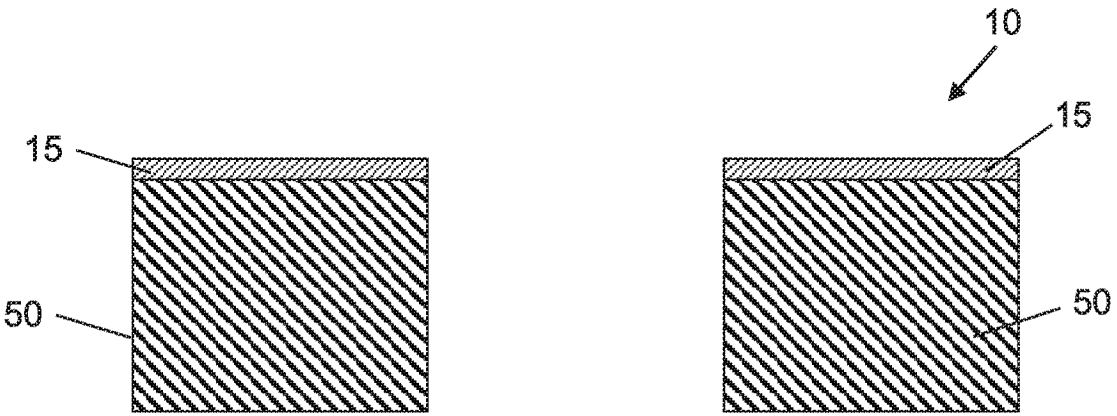
FIG. 6 is a cross-sectional view of a closed loop planar magnetic structure having an antiferromagnetic material formed on a ferromagnetic material in accordance with another embodiment.

Referring to FIG. 6, a cross-sectional view of the structure 10 is shown in accordance with another embodiment. The structure 10 includes AF material 15 (or 14) formed on a ferromagnetic material 50. The AF material or layer 15 pins the ferromagnetic material 50 (by annealing as described herein). The ferromagnetic material 50 can include Fe, Mn, Ni, Co, alloys or combinations of these and other magnetic materials, such as soft magnetic materials, e.g., $Ni_{45}Fe_{55}$, $Ni_{80}Fe_{20}$, Co—Zr—Ta, Co—Zr—Ti, Co—W—P, Co—W—B, Co—Fe—B, Co—B, Fe—P, Fe—B, Fe—N, Co—Zr—O, etc.

Figure 7:
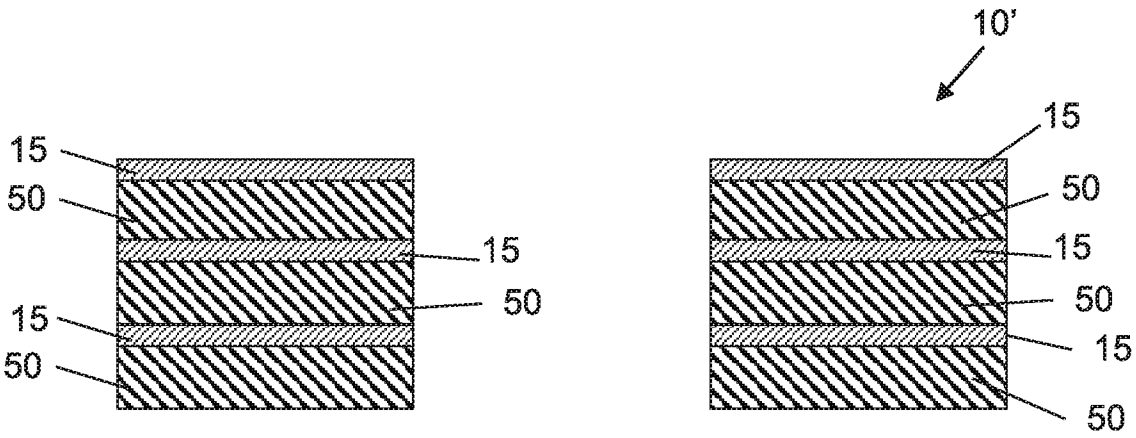
FIG. 7 is a cross-sectional view of a closed loop planar magnetic structure having alternating layers of antiferromagnetic material and ferromagnetic material in accordance with another embodiment.

Referring to FIG. 7, in other embodiments, a structure 10' can include multilayers of ferromagnetic material 50 and antiferromagnetic material 15 (or 14). For example, one layer 15 is antiferromagnetic, one layer 50 is ferromagnetic, followed by another antiferromagnetic layer 15 and then another ferromagnetic layer 50, etc. This can repeat to achieve a desired thickness. The coupling between the antiferromagnetic layers and ferromagnetic layers can be stronger in this embodiment than single layer embodiments. The stack of layers can begin with either an antiferromagnetic layer 15 or a ferromagnetic layer 50.

Figure 8:
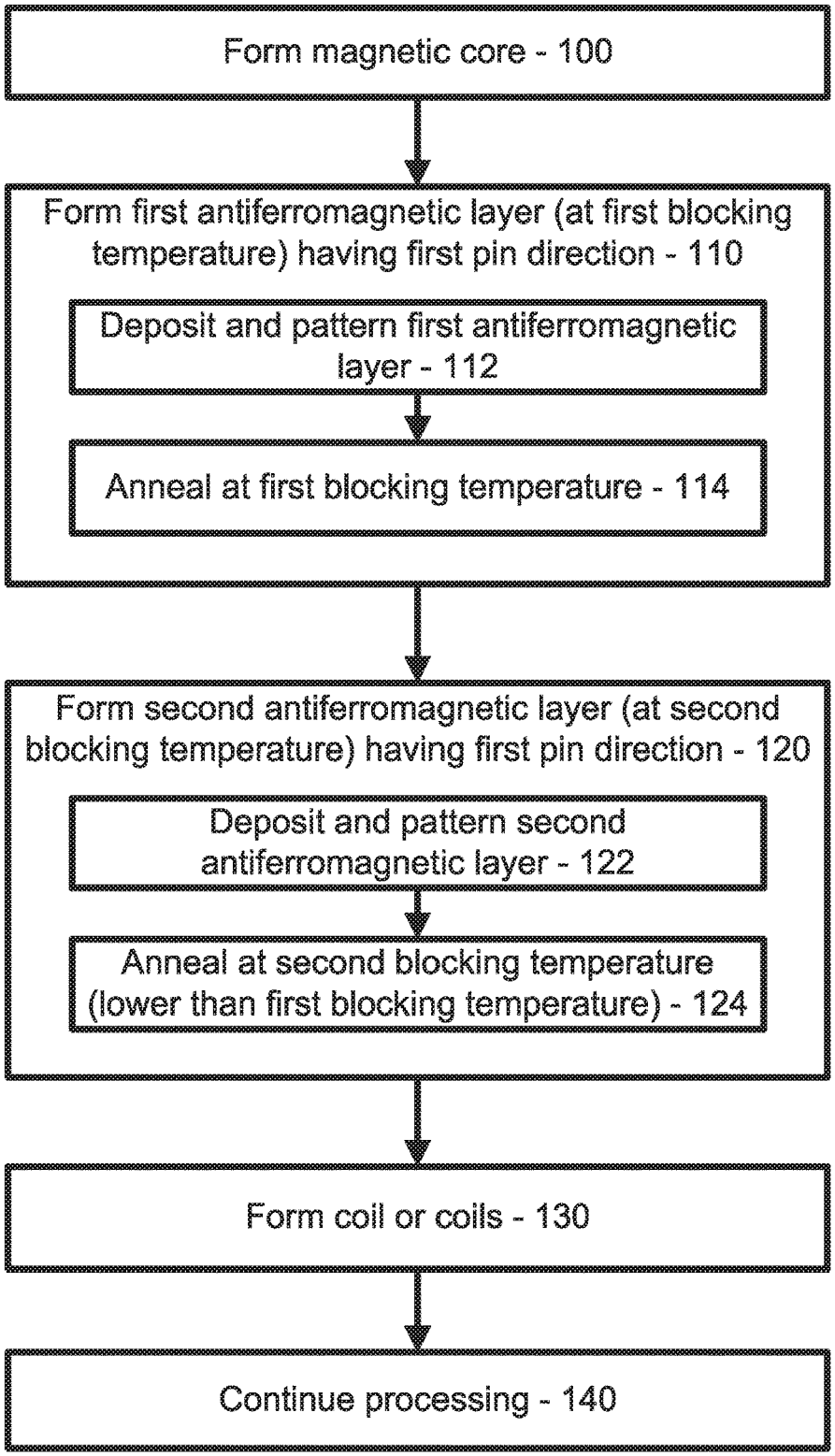
FIG. 8 is a block/flow diagram showing methods for forming a planar, closed loop magnetic structure in accordance with embodiments of the present invention.

Referring to FIG. 8, methods for forming a planar, closed loop magnetic structure are shown in accordance with illustrative embodiments. Planar refers to a single block of materials in one layer (or multiple continuous layers in contact with each other), e.g., there is no space or dielectrics between magnetic materials. Closed loop refers to a closed shape or contour, e.g., a torrid or polygon. The contour geometrically follows the closed loop.

In some alternative implementations, the functions noted in the blocks may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

In block 100, a planar, closed loop ferromagnetic core can be formed having a number of sides (e.g., a polygon with 3 or more sides, preferably 4 sides) or a continuous structure (circle, oval, torroid, etc.). The ferromagnetic core can be formed before or after the antiferromagnetic layers.

In block 110, a first antiferromagnetic layer is formed at a first blocking temperature for a closed magnetic loop to define a first pin direction for first magnetic moments. In block 112, the first antiferromagnetic layer is deposited and patterned on, e.g., two opposing sides of the ferromagnetic core. The deposition process can include a chemical vapor deposition (CVD) process, a sputtering process, an evaporation process, or any suitable deposition process. The patterning process can include a lithographic patterning process or any other suitable patterning process. In block 114, the first antiferromagnetic layer is annealed at the first blocking temperature to define a first pin direction for first magnetic moments.

In block 120, a second antiferromagnetic layer is formed at a second blocking temperature lower than the first blocking temperature for the closed magnetic loop to define a second pin direction different from the first pin direction for second magnetic moments. In block 122, the second antiferromagnetic layer is deposited and patterned on, e.g., two other opposing sides of the ferromagnetic core. The deposition process can include a CVD process, a sputtering process, an evaporation process, or any suitable deposition process. The patterning process can include a lithographic patterning process or any other suitable patterning process.

In block 124, the second antiferromagnetic layer is annealed at the second blocking temperature, which is lower than the first blocking temperature, to define a second pin direction for second magnetic moments. The second blocking temperature is lower to prevent damage or realignment of the first antiferromagnetic layer. The closed magnetic loop includes uniaxial anisotropy (with the antiferromagnetic pinnings) in each core segment and includes a high permeability direction around the closed loop ferromagnetic core when the coil is energized.

In block 130, a coil is formed around at least one core segment of the closed magnetic loop such that when the coil is energized the first and second magnetic moments rotate to follow a contour of the closed magnetic loop. This efficiently store magnetic energy in a closed magnetic loop arrangement. The closed magnetic loop can be formed on a substrate. The substrate may include a semiconductor substrate, a printed wiring board, etc. The coil can be formed using vias and metal lines in and through dielectric layers formed by semiconductor patterning processes.

First lines for a lower portion of the coil can be formed in a dielectric layer followed by the formation a second dielectric layer. The second dielectric layer can be patterned to form a place for the formation of the closed loop magnetic core within a single layer. Dielectric layers, second metal lines and vias to connect the second metal lines to the first metal are formed. The orientation of the first and second metal lines and the vias forms the coil(s) as needed. Other methods of forming the coils are also contemplated.

The coil can include forming a single coil wound about a single core segment, a single coil wound about at least two core segments or two (or more) separate coils wound about two (or more) core segments to form coupled inductors.

In block 140, processing continues with the formation of other structures and components to complete the device or devices. The devices are preferably formed on-chip, but can be formed on other substrates as well.

Having described preferred embodiments planar solenoid inductors with antiferromagnetic pinned cores (which are intended to be illustrative and not limiting), it is noted that modifications and variations can be made by persons skilled in the art in light of the above teachings. It is therefore to be understood that changes may be made in the particular embodiments disclosed which are within the scope of the invention as outlined by the appended claims. Having thus described aspects of the invention, with the details and particularity required by the patent laws, what is claimed and desired protected by Letters Patent is set forth in the appended claims.

What is claimed is:

1. A method for forming a planar, closed loop magnetic structure, comprising:

forming a first antiferromagnetic layer at a first blocking temperature for a closed magnetic loop to define a first pin direction for first magnetic moments;

forming a second antiferromagnetic layer at a second blocking temperature lower than the first blocking temperature for the closed magnetic loop to define a second pin direction different from the first pin direction for second magnetic moments; and forming a coil around at least one core segment of the closed magnetic loop such that when the coil is energized the first and second magnetic moments rotate to follow a contour of the closed magnetic loop.

2. The method as recited in claim 1, wherein the first and second pin directions are orthogonal to one another.

3. The method as recited in claim 1, wherein forming the coil includes forming a single coil wound about at least two core segments.

4. The method as recited in claim 1, wherein forming the coil includes forming two separate coils wound about two core segments to form coupled inductors.

5. The method as recited in claim 1, wherein the first and second antiferromagnetic layers are formed in contact with ferromagnetic material that forms a core of the closed magnetic loop.

6. The method as recited in claim 1, wherein the closed magnetic loop includes uniaxial anisotropy in each core segment and includes a high permeability direction around the closed magnetic loop when the coil is energized.

7. The method as recited in claim 1, wherein the closed magnetic loop includes four sides with opposite sides including a same antiferromagnetic material.

8. The method as recited in claim 1, wherein the closed magnetic loop is formed on a substrate and the coil is formed using vias and metal lines formed by semiconductor patterning processes.

9. A method for forming a planar, closed loop magnetic structure, comprising:

forming a planar, closed loop ferromagnetic core having four sides;

patterning a first antiferromagnetic layer on two opposing sides of the ferromagnetic core;

annealing the first antiferromagnetic layer at a first blocking temperature to define a first pin direction for first magnetic moments;

patterning a second antiferromagnetic layer on two other opposing sides of the ferromagnetic core;

annealing the second antiferromagnetic layer at a second blocking temperature, which is lower than the first blocking temperature to define a second pin direction for second magnetic moments; and forming a coil around at least one core segment of the closed loop ferromagnetic core such that when the coil is energized the first and second magnetic moments rotate to follow a contour of the closed loop ferromagnetic core.

10. The method as recited in claim 9, wherein forming the coil includes forming a single coil wound about at least two core segments.

11. The method as recited in claim 9, wherein forming the coil includes forming two separate coils wound about two core segments to form coupled inductors.

12. The method as recited in claim 11, wherein the closed magnetic loop includes uniaxial anisotropy in each core segment and includes a high permeability direction around the closed loop ferromagnetic core when the coil is energized.

* * * * *